US011007782B2

(12) United States Patent
Nakayama

(10) Patent No.: US 11,007,782 B2
(45) Date of Patent: May 18, 2021

(54) LIQUID EJECTING APPARATUS WITH CAP AND SUCTION MECHANISM

(71) Applicant: SEIKO EPSON CORPORATION, Tokyo (JP)

(72) Inventor: Rei Nakayama, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/745,732

(22) Filed: Jan. 17, 2020

(65) Prior Publication Data

US 2020/0230959 A1 Jul. 23, 2020

(30) Foreign Application Priority Data

Jan. 21, 2019 (JP) ..... JP2019-007550

(51) Int. Cl.
*B41J 2/165* (2006.01)
*B41J 2/175* (2006.01)

(52) U.S. Cl.
CPC ..... *B41J 2/16523* (2013.01); *B41J 2/16505* (2013.01); *B41J 2/17566* (2013.01)

(58) Field of Classification Search
CPC ..... B41J 2/16523; B41J 2/16505; B41J 2/16511; B41J 2/16585; B41J 2/16547; B41J 2/17566; B41J 2002/16594; B41J 2002/16597; B41J 2/1652; B41J 2/16532; B41J 2/16517; B41J 2/165; B41J 2002/16573
See application file for complete search history.

(56) References Cited

U.S. PATENT DOCUMENTS

2017/0136771 A1 5/2017 Ogawa
2017/0259573 A1* 9/2017 Iida ..... B41J 2/16523

FOREIGN PATENT DOCUMENTS

| | | |
|---|---|---|
| JP | 2015030174 | 2/2015 |
| JP | 2015066876 | 4/2015 |
| JP | 2016193558 | 11/2016 |
| JP | 2017087597 | 5/2017 |

* cited by examiner

*Primary Examiner* — Scott A Richmond
(74) *Attorney, Agent, or Firm* — Workman Nydegger

(57) ABSTRACT

A control method of a liquid ejecting apparatus including a liquid ejecting head that discharges a liquid from a nozzle, a cap configured to form a closed space where the nozzle is open, the cap being configured to move between a closed space forming position at which the cap forms the closed space and a retreated position at which the cap is farther from the liquid ejecting head than at the closed space forming position, and a suction mechanism configured to suck an inside of the cap, the method including: performing suction of the inside of the cap by the suction mechanism during the movement of the cap from the retreated position to the closed space forming position.

13 Claims, 7 Drawing Sheets

LIQUID EJECTING APPARATUS WITH CAP AND SUCTION MECHANISM

The present application is based on, and claims priority from JP Application Serial Number 2019-007550, filed Jan. 21, 2019, the disclosure of which is hereby incorporated by reference herein in its entirety

BACKGROUND

1. Technical Field

The present disclosure relates to a liquid ejecting apparatus such as a printer, and a control method of a liquid ejecting apparatus.

2. Related Art

For example, as disclosed in JP-A-2017-87597, there is a printer that is an example of a liquid ejecting apparatus that discharges a liquid from a nozzle formed in a liquid ejecting head to perform printing. The printer performs maintenance by sucking an inside of a cap portion through a tube, which is an example of a suction flow path, in a state in which the cap portion, which is an example of a cap, is in contact with the liquid ejecting head, and discharging ink from the nozzle.

When maintenance is performed, a liquid remains in the inside of the cap portion. Therefore, in the printer, the cap portion is moved away from the liquid ejecting head, and then the ink accumulated in the cap portion is discharged.

When the cap is moved, for example, the liquid remaining in the tube may return to the cap due to, for example, deformation of the tube or a change in a water head, thereby generating bubbles. When the cap comes into contact with the liquid ejecting head while holding the bubbles, there is a concern that the bubbles adhere to the nozzle and the quality of the liquid discharged from the nozzle is not maintained.

SUMMARY

According to a first aspect of the disclosure, there is provided a control method of a liquid ejecting apparatus including a liquid ejecting head that discharges a liquid from a nozzle, a cap configured to form a closed space where the nozzle is open, the cap being configured to move between the closed space forming position at which the cap forms the closed space and a retreated position at which the cap is farther from the liquid ejecting head than at the closed space forming position, and a suction mechanism configured to suck an inside of the cap, the method including performing suction of the inside of the cap by the suction mechanism during movement of the cap from the retreated position to the closed space forming position.

According to a second aspect of the disclosure, there is provided a liquid ejecting apparatus including a liquid ejecting head configured to discharge a liquid from a nozzle, a cap configured to form a closed space where the nozzle is open, the cap being configured to move between a closed space forming position at which the cap forms the closed space and a retreated position at which the cap is farther from the liquid ejecting head than at the closed space forming position, a suction mechanism configured to suck an inside of the cap, and a controller. The controller causes the suction mechanism to suck the inside of the cap during movement of the cap from the retreated position to the closed space forming position.

DESCRIPTION OF EXEMPLARY EMBODIMENTS

Hereinafter, an embodiment of a liquid ejecting apparatus and a control method of a liquid ejecting apparatus will be described with reference to the drawings. The liquid ejecting apparatus is, for example, an ink jet printer that discharges ink, which is an example of liquid, onto a medium such as a sheet, to perform printing.

Figure 1:
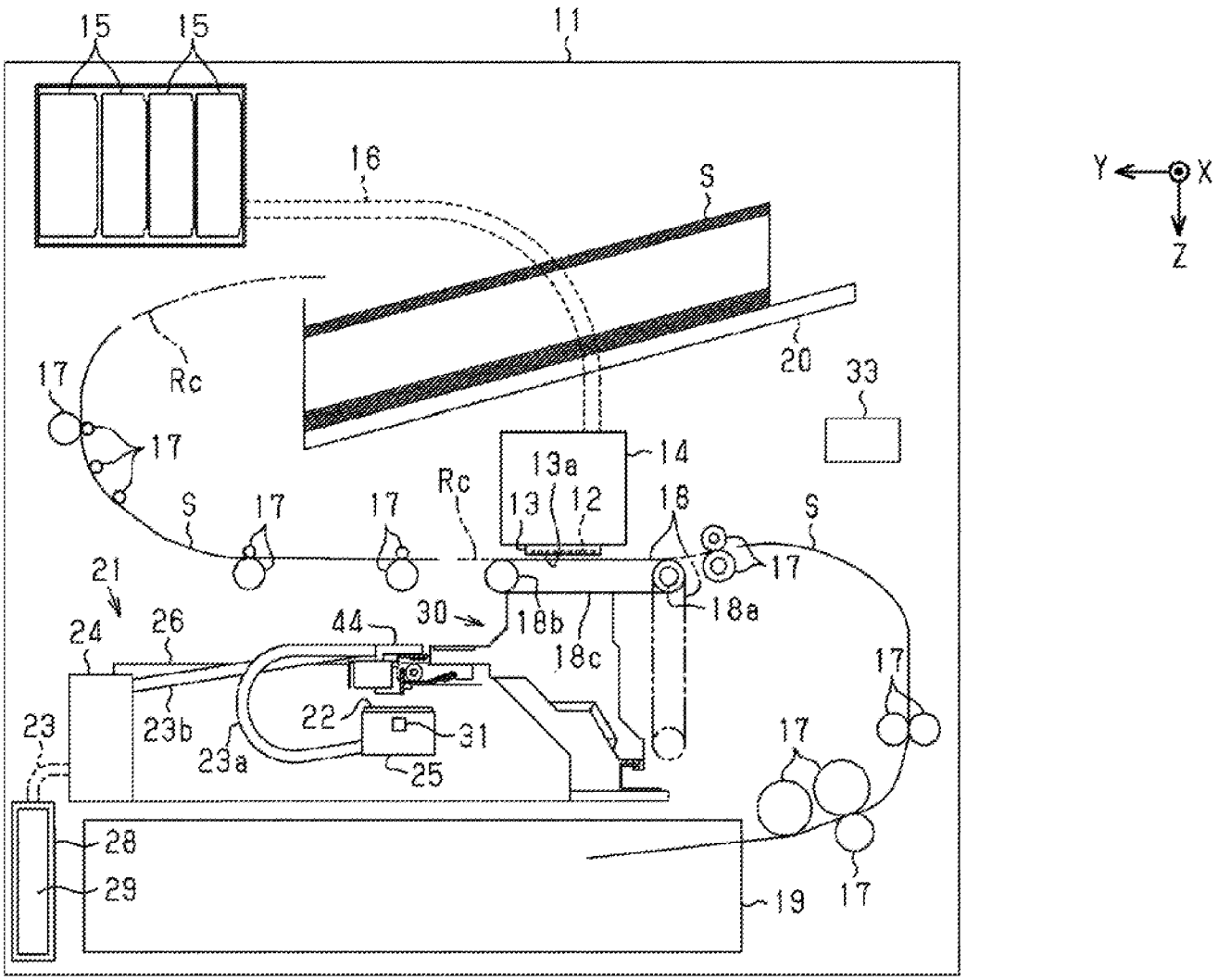
FIG. 1 is an overall configuration view of an embodiment of a liquid ejecting apparatus.

As illustrated in FIG. 1, a liquid ejecting apparatus 11 includes a liquid ejecting head 13 that discharges a liquid from a nozzle 12, a holding section 14 that holds the liquid ejecting head 13, and a supply flow path 16 for supplying the liquid from a liquid supply source 15 to the liquid ejecting head 13. The liquid ejecting head 13 includes a plurality of nozzles 12 that discharge the liquid and an opening surface 13*a* through which the nozzles 12 are open. In the present embodiment, a position at which the liquid ejecting head 13 discharges the liquid to perform printing on a medium S is referred to as a printing position.

The liquid ejecting apparatus 11 includes a plurality of transport rollers 17 that transport the medium S, and a medium support section 18 that supports the medium S at the printing position. The plurality of transport rollers 17 are disposed along a transport path Rc of the medium S that extends while curving from a storage cassette 19 toward a holding tray 20. The liquid ejecting apparatus 11 includes a maintenance device 21 that performs maintenance of the liquid ejecting head 13 at the printing position.

In the drawing, assuming that the liquid ejecting apparatus 11 is placed on a horizontal plane, a direction of gravity is indicated by a Z-axis, and directions along a plane intersecting the Z-axis are indicated by an X-axis and a Y-axis. When the X-axis, the Y-axis, and the Z-axis are orthogonal to each other, the X-axis and the Y-axis are along the horizontal plane. In the following description, a direction along the X-axis is also referred to as a width direction X, a direction along the Y-axis is also referred to as a transport direction Y, and a direction along the Z-axis is also referred to as a discharging direction Z. The transport direction Y is a direction in which the medium S is transported at the printing position. The discharging direction Z is a direction in which the liquid ejecting head 13 discharges the liquid.

The medium support section 18 is configured to be movable between a support position indicated by a solid line in FIG. 1, at which the medium S is supported in a transport path Rc of the medium S and a non-support position indicated by a two-dot chain line in FIG. 1, which is away from the transport path Rc. The medium support section 18 includes, for example, a driving roller 18*a*, a driven roller 18*b*, and a transport belt 18*c* that is stretched over the driving roller 18*a* and the driven roller 18*b*. The medium support section 18 moves between the support position and the non-support position by pivoting the driven roller 18*b* and the transport belt 18*c* substantially 90 degrees about the driving roller 18*a*.

The liquid supply source 15 is, for example, a cartridge type liquid container that is detachably attached to the liquid ejecting apparatus 11. Alternatively, a configuration may be adopted in which the liquid supply source 15 is a liquid tank equipped in the liquid ejecting apparatus 11 and the liquid is supplied by being injected into the liquid tank.

The liquid ejecting head 13 of the present embodiment is a line head of which the width direction X is a longitudinal direction. The liquid ejecting head 13 performs printing by discharging the liquid toward the medium S that is transported in the transport direction Y by the medium support section 18 located at the support position. A printing range of the liquid ejecting head 13 that is the line head covers an entire width of the medium S. The discharging direction Z of the present embodiment is the direction of the gravity, but the liquid ejecting head 13 may discharge the liquid in a direction different from the direction of the gravity.

The maintenance device 21 includes a cap 22, a suction flow path 23 of which an upstream end is coupled to the cap 22, a suction mechanism 24 capable of sucking an inside of the cap 22 via the suction flow path 23, a cap holder 25 that holds the cap 22, and a moving mechanism 26 that moves the cap 22. The cap 22 comes into contact with the opening surface 13*a* to cover the nozzles 12, thereby forming a closed space surrounding the nozzles 12 with the opening surface 13*a*. The suction mechanism 24 may be, for example, a tube pump or a diaphragm pump.

The maintenance device 21 includes a mounting portion 28 to which a downstream end of the suction flow path 23 is coupled. A waste liquid container 29 capable of storing a waste liquid is mounted on the mounting portion 28. The maintenance device 21 may include a wiping device 30 that performs wiping of the liquid ejecting head 13, and an atmosphere opening portion 31 capable of opening the closed space formed by the cap 22 and the liquid ejecting head 13 to the atmosphere.

The maintenance device 21 performs a maintenance operation such as flushing, capping, suction cleaning, or wiping in order to prevent or eliminate a discharging defect occurring in the liquid ejecting head 13. When the maintenance device 21 performs the maintenance operation, the medium support section 18 moves from the support position to the non-support position.

The liquid ejecting apparatus 11 includes a controller 33 that controls operations of the liquid ejecting head 13 and the maintenance device 21. The controller 33 is configured, for example, of a processing circuit including a computer and a memory, and controls various operations executed by the liquid ejecting apparatus 11 in accordance with programs stored in the memory.

Figure 2:
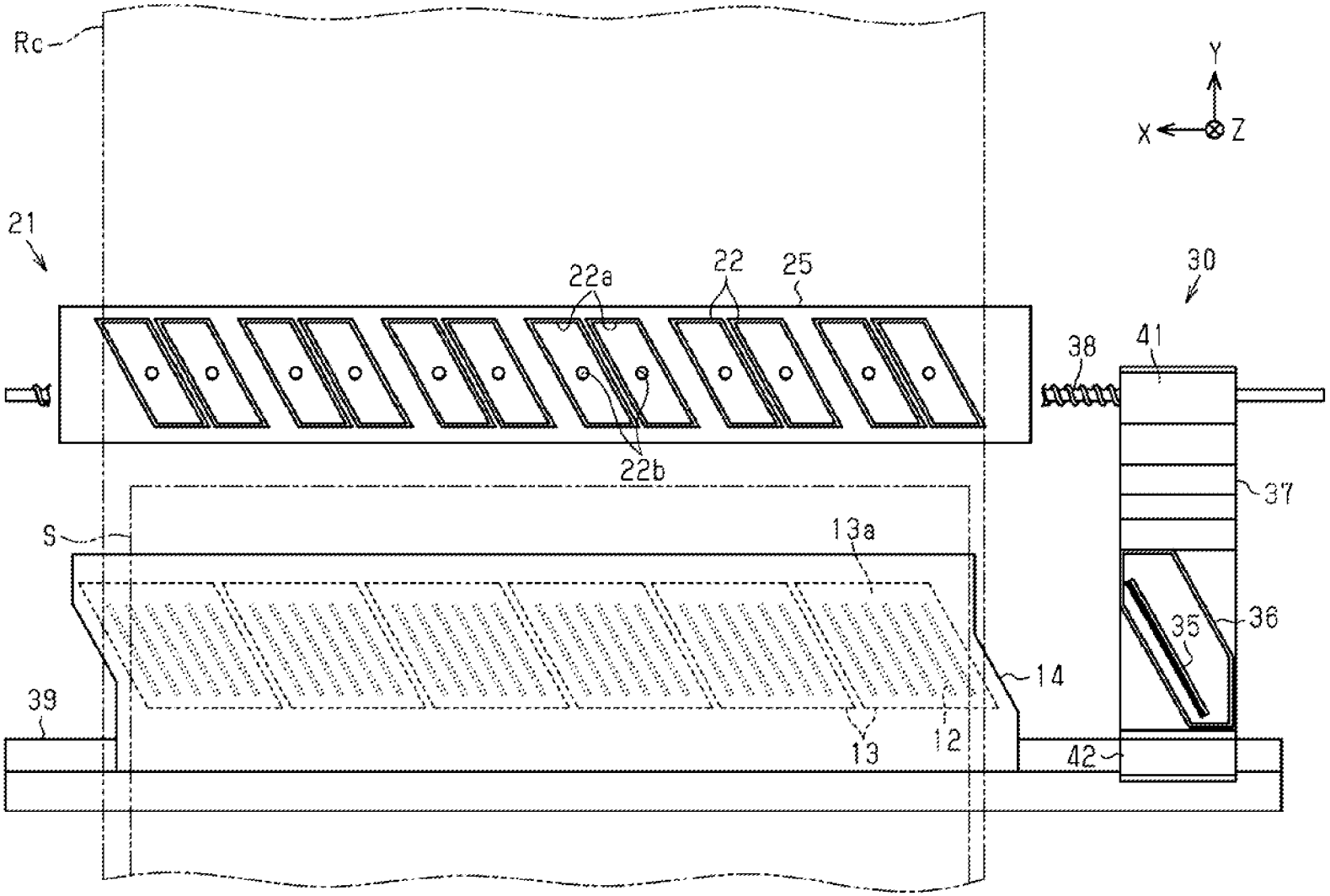
FIG. 2 is a plan view of a maintenance device and a liquid ejecting head included in the liquid ejecting apparatus.

As illustrated in FIG. 2, the cap 22 is provided with an opening portion 22*a* that is open upward, and a suction port 22*b* that communicates with the suction mechanism 24 via the suction flow path 23. The suction port 22*b* is an opening formed on an inner surface of the cap 22 in holes formed penetrating through a side wall or a bottom wall constituting the cap 22.

The liquid ejecting apparatus 11 includes a plurality of liquid ejecting heads 13 aligned in the width direction X. The plurality of nozzles 12 included in one liquid ejecting head 13 form nozzle rows by being arranged in a direction oblique to the transport direction Y and the width direction X. In the liquid ejecting head 13, a plurality of nozzle rows are disposed at predetermined intervals in the width direction X. The maintenance device 21 according to the present embodiment has two caps 22 aligned in the width direction X with respect to one liquid ejecting head 13. The number of caps 22 can be any changed.

The wiping device 30 includes a wiping member 35 capable of wiping the liquid ejecting head 13, a liquid storing portion 36 surrounding the wiping member 35, and a moving object 37 that moves while holding the wiping member 35 and the liquid storing portion 36. The wiping device 30 includes a guide shaft 38 and a guide plate 39 that guide the movement of the wiping member 35 via the moving object 37.

The wiping member 35 is, for example, an absorbent body capable of absorbing the liquid, such as an elastic body made of an elastomer or the like, or a nonwoven fabric. The guide shaft 38 is, for example, a screw shaft extending in the width direction X. The moving object 37 is provided with a first engagement portion 41 that is screwed with the guide shaft 38 and a second engagement portion 42 that is engaged with the guide plate 39.

When the guide shaft 38, which is a screw shaft, rotates in a first rotation direction, the moving object 37 moves forward in the width direction X, and when the guide shaft 38 rotates in a second rotation direction, which is the opposite direction of the first rotation direction, the moving object 37 moves backward in the direction opposite to the width direction X. The wiping member 35 comes into contact with the liquid ejecting head 13 while moving in at least one of the forward movement and the backward movement, thereby wiping off the liquid or the like adhering to the liquid ejecting head 13. This is called wiping.

Figure 3:
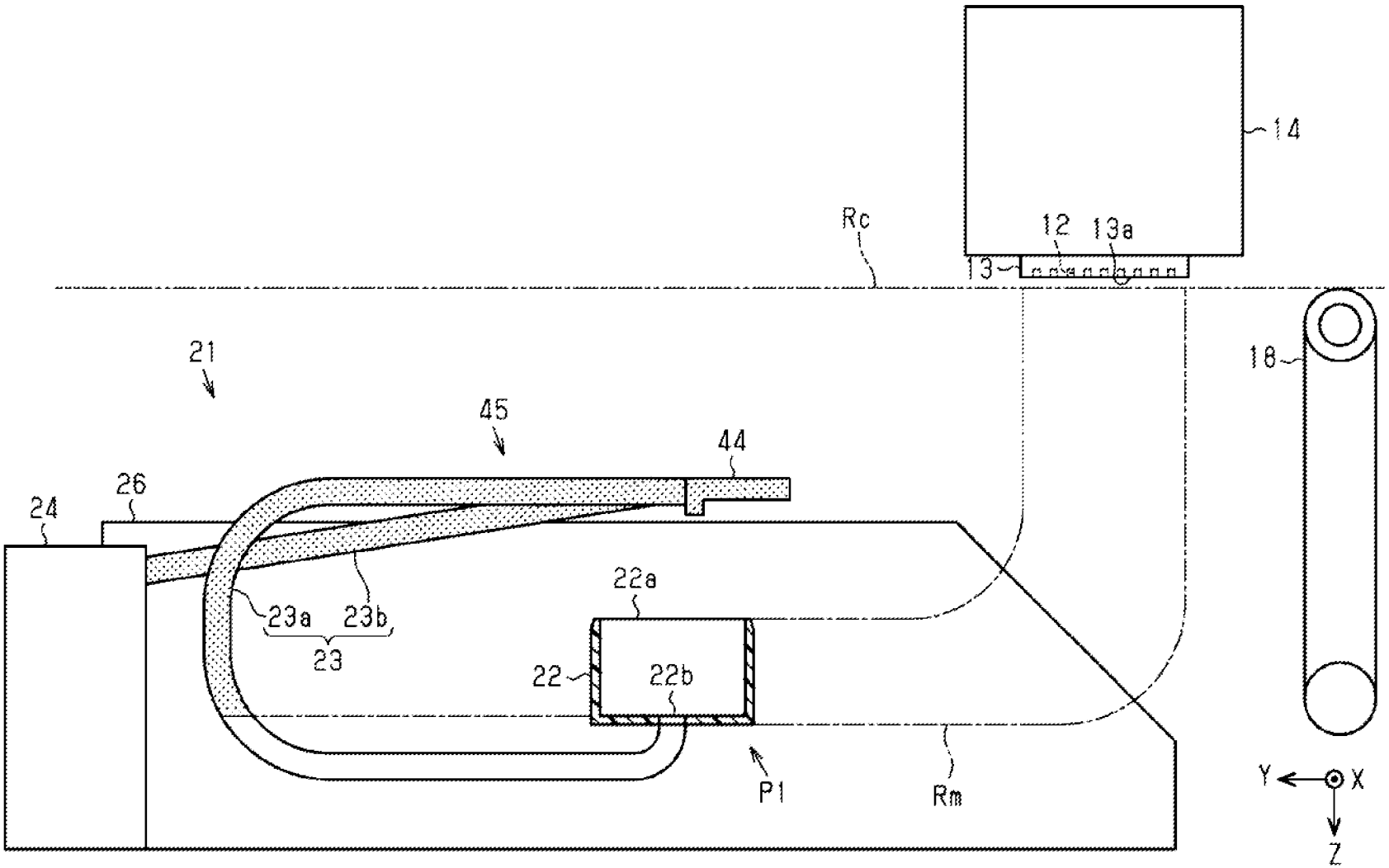
FIG. 3 is a schematic view of a cap located at a retreated position.
Figure 4:
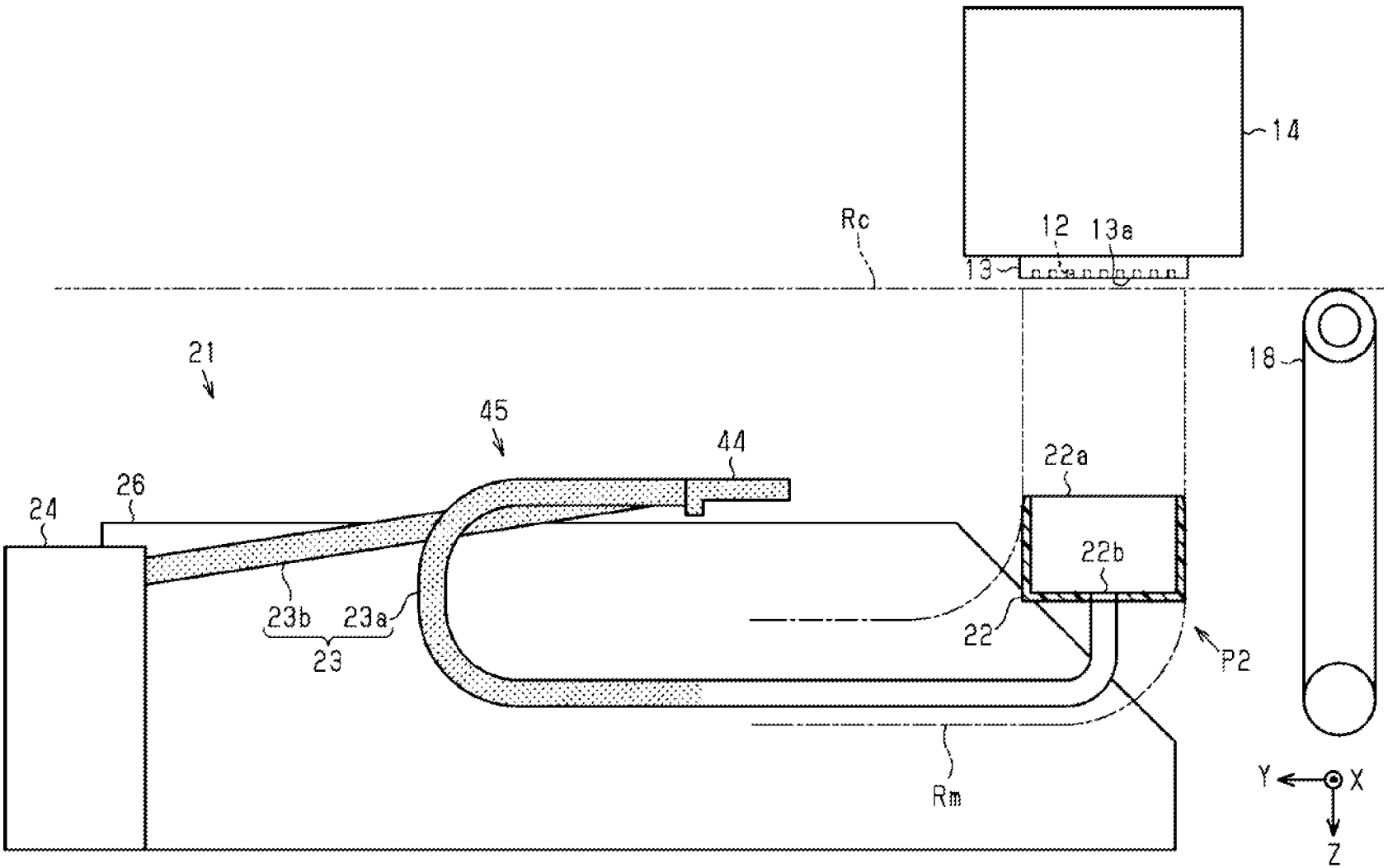
FIG. 4 is a schematic view of the cap located at a facing position.
Figure 5:
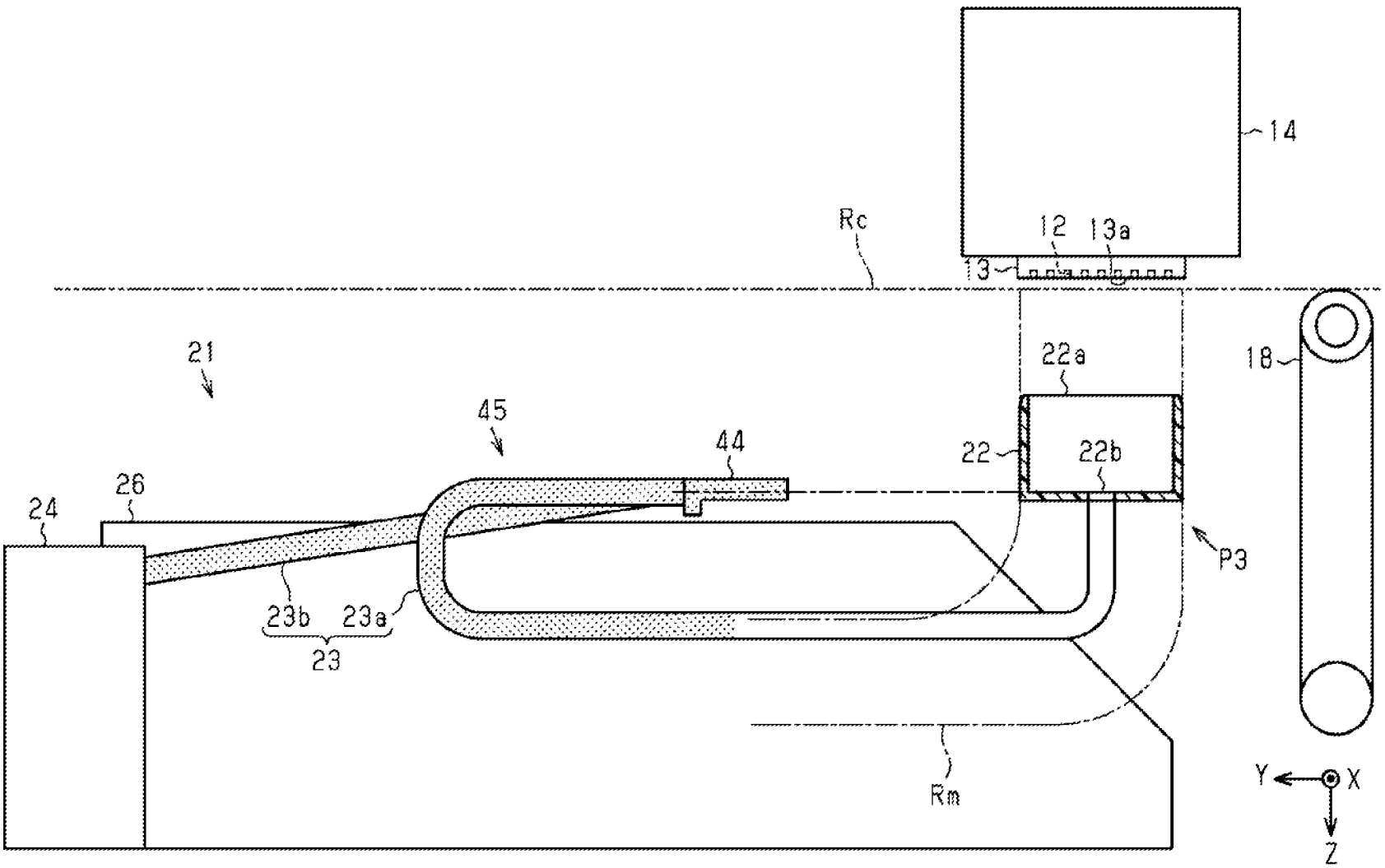
FIG. 5 is a schematic view of the cap located at an intermediate position.

As illustrated in FIG. 3, the suction flow path 23 is formed by including an upstream tube 23*a* coupled to the cap 22, a downstream tube 23*b* provided with the suction mechanism 24, and a joint member 44 coupling the upstream tube 23*a* and the downstream tube 23*b*. The upstream tube 23*a* couples the cap 22 and the joint member 44 to each other. The downstream tube 23*b* couples the joint member 44 and the mounting portion 28 to each other.

The upstream tube 23*a* and the downstream tube 23*b* can be bent and deformed. If the upstream tube 23*a* and the downstream tube 23*b* are bent and curved in accordance with the movement of the cap 22, the liquid may not flow easily. The joint member 44 may be fixed to be provided in a middle of the suction flow path 23. If the joint member 44 is provided so as not to move, the upstream tube 23*a* bends to be deformed following the movement of the cap 22, but the downstream tube 23*b* does not bend to be deformed, and a behavior of the suction flow path 23 can be stabilized. In this case, in the suction flow path 23, a portion between the joint member 44 and the mounting portion 28 may be formed of a rigid member that does not bend to be deformed.

Next, the movement of the cap 22 will be described.

As illustrated in FIGS. 3 to 6, the cap 22 moves along a movement path Rm. Specifically, the cap 22 located at a retreated position P1 illustrated in FIG. 3 moves to a closed space forming position P4 illustrated in FIG. 6 through a facing position P2 illustrated in FIG. 4 and an intermediate position P3 illustrated in FIG. 5 in this order. The cap 22 located at the closed space forming position P4 moves to the retreated position P1 through the intermediate position P3 and the facing position P2 in this order. The cap 22 is provided so as to be movable between the closed space forming position P4 that forms a closed space where the nozzle 12 is open and the retreated position P1 that is farther away from the liquid ejecting head 13 than is the closed space forming position P4.

The retreated position P1 is a position farthest from the liquid ejecting head 13 in the movement path Rm. The facing position P2 is a position at which the opening portion 22*a* of the cap 22 and the nozzle 12 can face each other. The cap 22 that has moved to the facing position P2 rises while facing the nozzle 12 and reaches the intermediate position P3. The intermediate position P3 is a position at which the joint member 44 and the suction port 22*b* are at the same height. The cap 22 further rises from the intermediate position P3 and reaches the closed space forming position P4. The closed space forming position P4 is a position closest to the liquid ejecting head 13 in the movement path Rm, and is a position at which the cap 22 comes into contact with the liquid ejecting head 13.

Figure 6:
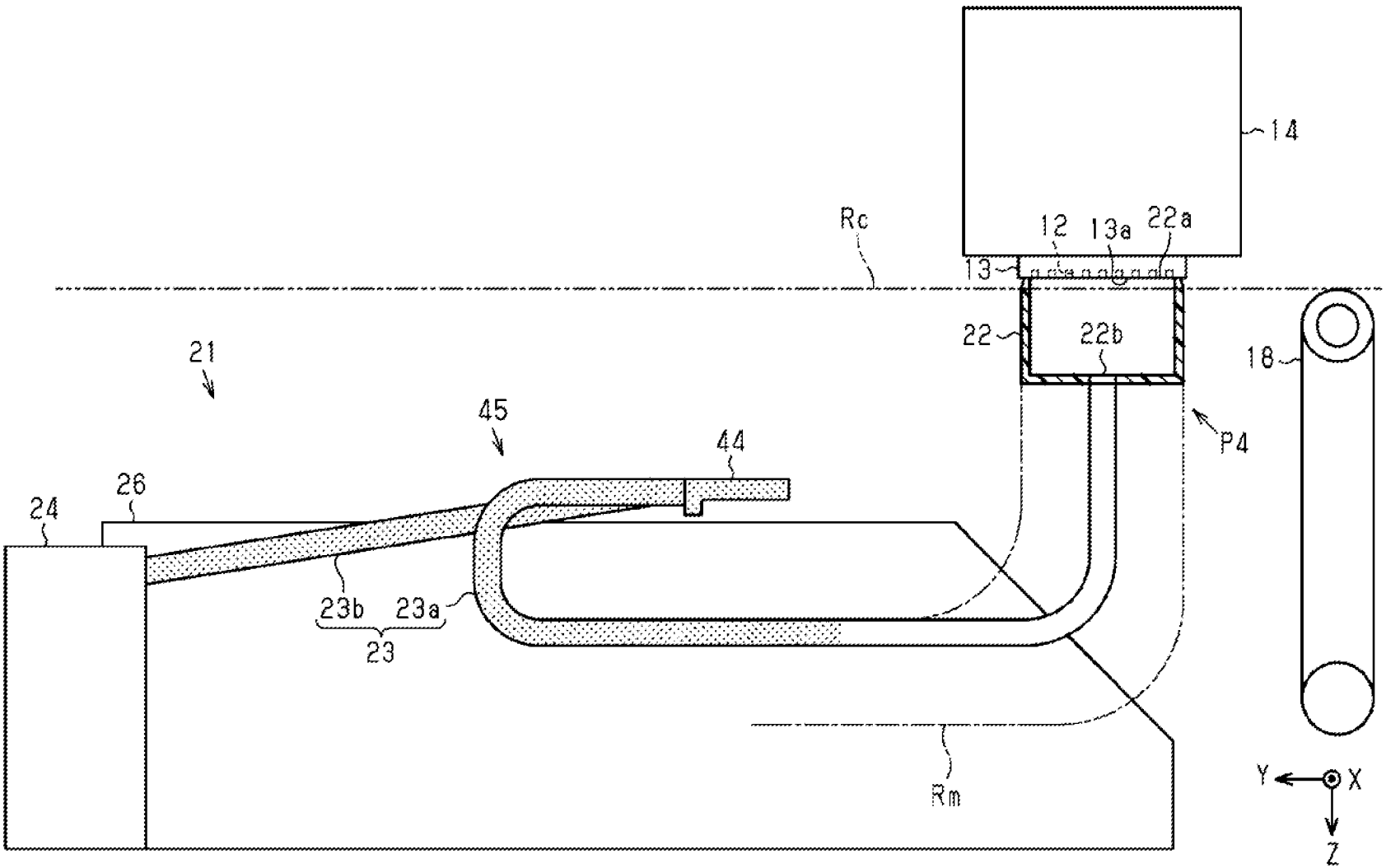
FIG. 6 is a schematic view of the cap located at a closed space forming position.

The joint member 44 may be provided at a position vertically above the suction port 22*b* of the cap 22 located at the retreated position P1 illustrated in FIG. 3, and at a position vertically below the suction port 22*b* of the cap 22 located at the closed space forming position P4 illustrated in FIG. 6. That is, the joint member 44 is included in an intermediate portion 45 illustrated by hatching in FIGS. 3 to 6, which is a portion located vertically above the suction port 22*b* of the cap 22 at the retreated position P1 in the suction flow path 23 and located vertically below the suction port 22*b* of the cap 22 at the closed space forming position P4.

In the present embodiment, the joint member 44 is provided at a highest position in the intermediate portion 45. In other words, in the intermediate portion 45, the joint member 44 is located vertically above the other portions in the intermediate portion 45.

Vertically above is not limited to just above. Vertical below is not limited to just below. That is, the intermediate portion 45 may be located at a position that is shifted in a horizontal direction with respect to the suction port 22*b* of the cap 22 located at the retreated position P1, and a position that is higher than the suction port 22*b*. The intermediate portion 45 may be located at a position that is shifted in the horizontal direction with respect to the suction port 22*b* of the cap 22 located at the closed space forming position P4, and a position that is lower than the suction port 22*b*.

When the medium S is transported along the transport path Rc, such as during printing, the medium support section 18 is disposed at the printing position, and the cap 22 is disposed at the retreated position P1. When the medium support section 18 moves to a non-supporting position such as after the printing is finished, the cap 22 moves to the closed space forming position P4 and comes into contact with the liquid ejecting head 13 to perform capping. When the liquid ejecting head 13 does not discharge the liquid, the cap 22 performs the capping to suppress drying of the nozzle 12. In the present embodiment, the cap 22 comes into contact with the opening surface 13*a* to perform the capping, but the cap 22 may come into contact with a side surface of the liquid ejecting head 13 to perform the capping.

Flushing is a maintenance operation that discharges foreign matter, bubbles, deteriorated liquid, or the like that causes discharging failure by discharging the liquid from the nozzles 12 regardless of the printing. The deterioration is, for example, thickening due to evaporation of a solvent component. The flushing may be performed before or after the printing, or may be performed during the printing.

The flushing is performed in a state in which the cap 22 is located at a flushing position (not illustrated) between the intermediate position P3 and the closed space forming position P4, and the cap 22 is separated from the liquid ejecting head 13. After the waste liquid discharged by the flushing is received by the cap 22, the suction mechanism 24 may be driven to perform idle suction. When the idle suction is executed, the liquid received in the cap 22 is stored in the waste liquid container 29 through the suction flow path 23.

When the liquid ejecting head 13 discharges the liquid, fine mist is generated and adheres to the liquid ejecting head 13. Further, when the medium S is transported, paper dust or dust is scattered and adheres to the liquid ejecting head 13. Therefore, the wiping device 30 performs the wiping at a predetermined timing such as after execution of the printing.

The cap 22 is located at the closed space forming position P4 and performs the capping of the liquid ejecting head 13. When the suction mechanism 24 is driven during the capping, the closed space formed between the cap 22 and the liquid ejecting head 13 is in a negative pressure. Then, the inside of the nozzle 12 is sucked by the negative pressure, and foreign matter such as bubbles is discharged together with the liquid. This is called suction cleaning.

The suction cleaning is performed in a state in which the atmosphere opening portion 31 does not cause the inside of the cap 22 to communicate with the atmosphere. After the suction cleaning is performed, the liquid in the inside of the cap 22 is discharged by driving the suction mechanism 24 in a state in which the atmosphere opening portion 31 causes the inside of the cap 22 to communicate with the atmosphere. The liquid discharged from the nozzle 12 by the suction cleaning is stored in the waste liquid container 29 through the suction flow path 23 as the waste liquid.

Figure 7:
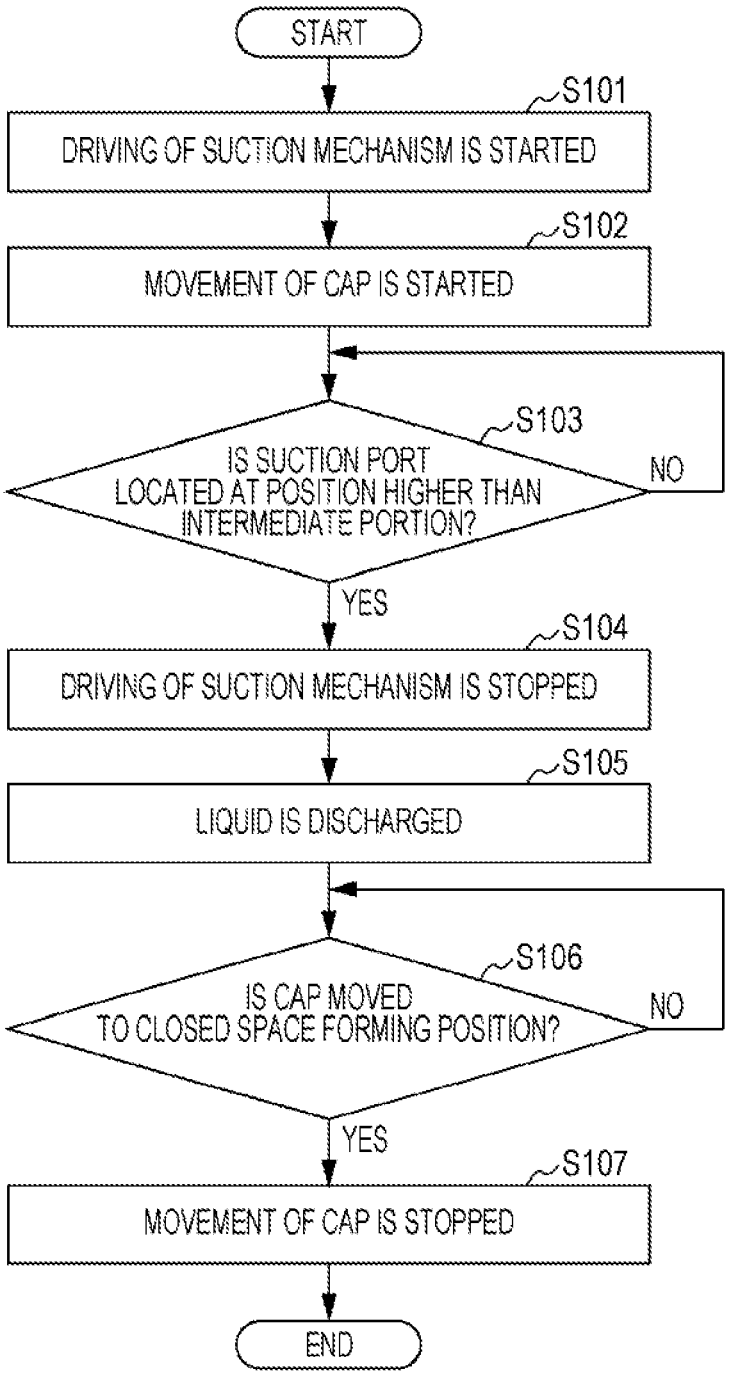
FIG. 7 is a flowchart illustrating a capping routine.

Next, a control method of the liquid ejecting apparatus 11 will be described with reference to a flowchart illustrated in FIG. 7. This capping routine is executed by the controller 33 when maintenance is performed in accordance with the movement of the cap 22 such as the capping or the suction cleaning in a state in which the cap 22 is located at the retreated position P1.

In step S101, the controller 33 starts driving of the suction mechanism 24. In step S102, the controller 33 causes the movement of the cap 22 located at the retreated position P1 to start toward the closed space forming position P4. That is, before the cap 22 starts the movement from the retreated position P1, the controller 33 causes the suction mechanism 24 to start the suction of the inside of the cap 22, and suck the inside of the cap 22 during the movement of the cap 22 from the retreated position P1 to the closed space forming position P4.

In step S103, the controller 33 determines whether or not the suction port 22*b* is located at a position higher than the intermediate portion 45. In the present embodiment, the joint member 44 is located at the highest position in the intermediate portion 45. Therefore, when the suction port 22*b* is located at a position at the same height as that of or lower than the joint member 44, the determination result in step S103 is NO, and the controller 33 waits until the suction port 22*b* moves to a position higher than the joint member 44. When the suction port 22*b* moves to the position higher than the joint member 44, the determination result in step S103 is YES, and the controller 33 causes the process to proceed to step S104.

In step S104, the controller 33 stops driving of the suction mechanism 24. That is, the controller 33 stops the suction of the inside of the cap 22 by the suction mechanism 24 after the suction port 22*b* of the cap 22 reaches a position higher than the intermediate portion 45. After the suction port 22*b* reaches the position higher than the joint member 44, when the controller 33 quickly stops the driving of the suction mechanism 24, the suction of the inside of the cap 22 stops at a position at which the suction port 22*b* of the cap 22 is closer to the intermediate portion 45 than to the liquid ejecting head 13 in the vertical direction.

In step S105, the controller 33 causes the liquid to discharge from the nozzle 12. The liquid discharged from the nozzle 12 is received by the cap 22. That is, the controller 33 causes the liquid to discharge from the nozzle 12 into the cap 22 after the suction of the inside of the cap 22 by the suction mechanism 24 is stopped and before the cap 22 reaches the closed space forming position P4. The controller 33 may cause the liquid to discharge toward the cap 22 located at a receiving position (not illustrated) where, for example, the suction port 22*b* of the cap 22 is closer to the liquid ejecting head 13 than to the intermediate portion 45 in a discharging direction Z. The receiving position may be the same position as the flushing position described above.

In step S106, the controller 33 determines whether or not the cap 22 has moved to the closed space forming position P4. When the cap 22 has not moved to the closed space forming position P4, the determination result in step S106 is NO, and the controller 33 waits until the cap 22 moves to the closed space forming position P4. When the cap 22 moves to the closed space forming position P4, the determination result in step S106 is YES, and the controller 33 causes the process to proceed to step S107. In step S107, the controller 33 stops the movement of the cap 22 and ends the process.

An operation of the present embodiment will be described.

The controller 33 causes the liquid to discharge into the cap 22, and then the cap 22 to locate at the closed space forming position P4 to perform the capping. The cap 22 located at the closed space forming position P4 holds the liquid. The liquid inside the cap 22 and the suction flow path 23 is not limited to the moisturizing liquid, and a liquid discharged due to the suction cleaning or the flushing may remain.

When the cap 22 located at the closed space forming position P4 descends and passes through the intermediate position P3, the suction port 22*b* is lower than the joint member 44. Therefore, the liquid in the suction flow path 23 flows into the cap 22 so as to push out the air in the suction flow path 23, and bubbles may be generated in the cap 22. The upstream tube 23*a* is deformed as the cap 22 moves, so that the liquid or the like in the upstream tube 23*a* is pushed into the cap 22 and bubbles may be generated not only when the cap 22 descends but also when the cap 22 ascends.

When the liquid ejecting apparatus 11 discharges a plurality of different types of liquid, if the bubbles come into contact with the nozzle 12, the different types of liquid are mixed together, and the quality of the liquid discharged from the nozzles 12 is deteriorated. Specifically, when the nozzles 12 discharge a plurality of colors of ink, if the bubbles come into contact with the nozzle 12, the ink in the nozzles 12 and the ink forming the bubbles may be mixed and the colors thereof may be mixed. Even when the liquid ejecting apparatus 11 discharges one type of liquid, if the bubbles, which are formed by the liquid of which viscosity has been increased by coming into contact with the air, comes into contact with the nozzles 12, the quality of the liquid discharged from the nozzles 12 is deteriorated. That is, when liquid having high viscosity, which forms bubbles, comes into contact with the nozzles 12, the viscosity of the liquid in the nozzles 12 may be increased.

Therefore, in the present embodiment, the suction mechanism 24 sucks the inside of the cap 22 to suppress the generation of the bubbles, and after the bubbles in the cap 22 are discharged, the liquid ejecting head 13 is capped.

Effects of the present embodiment will be described.

(1) During the movement of the cap 22 from the retreated position P1 to the closed space forming position P4, the inside of the cap 22 is sucked by the suction mechanism 24. Therefore, even when the bubbles are generated in the cap 22, the cap 22 can be located at the closed space forming position P4 after the bubbles are sucked. Therefore, a concern that the bubbles in the cap 22 come into contact with the nozzle 12 can be reduced, and the deterioration of the quality of the liquid discharged from the nozzle 12 can be suppressed.

(2) The bubbles in the cap 22 may be generated as the cap 22 moves. In that respect, since the suction mechanism 24 sucks the inside of the cap 22 before the cap 22 starts the movement or simultaneously with the start of the movement, the generation of bubbles can be suppressed.

(3) The bubbles in the cap 22 are likely to be generated when the liquid or the like flows from the suction flow path 23 toward the suction port 22*b*. Therefore, when the suction port 22*b* is located at a position lower than the intermediate portion 45, the bubbles are likely to be generated, whereas when the suction port 22*b* is located at a position higher than the intermediate portion 45, the bubbles are unlikely to be generated. In a state in which the suction port 22*b* is located at a position lower than the intermediate portion 45 and the bubbles are likely to be generated, the suction is continued by the suction mechanism 24. Therefore, compared with a case in which the suction by the suction mechanism 24 is stopped before the suction port 22*b* reaches a position higher than the intermediate portion 45, a concern that the bubbles are generated can be reduced.

(4) After the suction port 22*b* reaches a position higher than the intermediate portion 45, the suction by the suction mechanism 24 is stopped at a position at which the suction port 22*b* is closer to the intermediate portion 45 than to the liquid ejecting head 13. Therefore, a concern that the negative pressure by the suction mechanism 24 affects the nozzle 12 can be reduced.

(5) The cap 22 that moves from the retreated position P1 to the closed space forming position P4 discharges the liquid in the inside by the suction of the suction mechanism 24. Thereafter, the liquid is discharged from the nozzle 12 into the cap 22 until the cap 22 reaches the closed space forming position P4 after the suction in the cap 22 is stopped. Therefore, the cap 22 located at the closed space forming position P4 can keep the nozzle 12 moisturize by the liquid in the inside.

(6) The closed space formed by the cap 22 located at the closed space forming position P4 can be opened to the atmosphere by the atmosphere opening portion 31. Therefore, after the inside of the cap 22 forming the closed space is sucked and the liquid is discharged from the nozzle 12, the closed space is opened to the atmosphere, so that the liquid in the cap 22 can be discharged while the cap 22 is located at the closed space forming position P4.

(7) The intermediate portion 45 of the suction flow path 23 includes the joint member 44 that is fixedly provided. Therefore, the intermediate portion 45 can be easily located at a position vertically above the suction port 22*b* of the cap 22 located at the retreated position P1 and at a position vertically below the suction port 22*b* of the cap 22 located at the closed space forming position P4.

(8) The controller 33 causes the inside of the cap 22 to be sucked during the movement of the cap 22.

Therefore, for example, compared with a case in which the cap 22 is moved after the inside of the cap 22 is sucked, a time until the liquid ejecting head 13 is capped can be shortened. The viscosity of the liquid in the nozzle 12 becomes thicker as an uncapped time becomes longer, and an amount of the liquid discharged to recover the state of the nozzle 12 also increases. Therefore, quick capping can be performed so that the amount of liquid to be discharged can be reduced.

The present embodiment can be implemented with the following modifications. The present embodiment and the following modifications can be implemented in combination with each other within a technically consistent range.

In the cap 22, an absorber which absorbs a liquid may be provided.

The cap 22 may receive the liquid discharged by so-called pressure cleaning in which the liquid in the liquid ejecting head 13 is pressurized to be discharged from the nozzle 12.

The moving mechanism 26 may change a first moving speed of the cap 22 from the retreated position P1 toward the closed space forming position P4 and a second moving speed of the cap 22 from the closed space forming position P4 toward the retreated position P1. When the first moving speed is slower than the second moving speed, the bubbles in the cap 22 can be further reduced.

The liquid ejecting apparatus 11 may include a negative pressure accumulator that can accumulate a negative pressure in the middle of the suction flow path 23. The suction in the cap 22 performed during the movement of the cap 22 may be performed by the negative pressure accumulated in the negative pressure accumulator.

The controller 33 may drive the suction mechanism 24 to discharge the liquid in the cap 22, for example, when the amount of the liquid discharged by flushing and received by the cap 22 exceeds a first threshold value.

The controller 33 may perform the idle suction for discharging the liquid in the cap 22 by driving the suction mechanism 24 in a state in which the inside of the cap 22 is opened to the atmosphere after the suction cleaning is performed. The idle suction may be performed by separating the cap 22 from the liquid ejecting head 13. The time for performing the idle suction may be longer than the time for performing the suction during the movement of the cap 22 from the retreated position P1 to the closed space forming position P4. A first suction speed at which the suction mechanism 24 sucks the liquid when the idle suction is performed may be different from a second suction speed at which the suction mechanism 24 sucks the liquid during the movement of the cap 22. If the first suction speed is faster than the second suction speed, the liquid in the cap 22 can be quickly discharged during the idle suction. The bubbles in the cap 22 can be discharged to bubbles located at a position away from the suction port 22*b* when the suction speed is slower. Therefore, if the second suction speed is slower than the first suction speed, the bubbles in the cap 22 can be easily discharged.

The controller 33 may determine whether or not to drive the suction mechanism 24 performed during the movement of the cap 22 according to the amount of liquid in the cap 22. For example, the controller 33 may drive the suction mechanism 24 during the movement of the cap 22 when the liquid in the cap 22 is greater than a second threshold value. The controller 33 may not drive the suction mechanism 24 during the movement of the cap 22 when the liquid in the cap 22 is equal to or less than the second threshold value.

The liquid ejecting apparatus 11 may include a detector that measures a temperature, or may acquire a temperature measured by a detector that is provided separately from the liquid ejecting apparatus 11. The temperature measured by the detector may be, for example, a temperature of a member constituting the liquid ejecting apparatus 11 such as the opening surface 13*a* or the cap 22, a temperature of the air in the liquid ejecting apparatus 11, or a temperature of an environment in which the liquid ejecting apparatus 11 is installed. The controller 33 may determine whether or not to drive the suction mechanism 24 performed during the movement of the cap 22 according to the temperature. For example, when the temperature is higher than the threshold temperature, the controller 33 may not drive the suction mechanism 24 during the movement of the cap 22. When the measured temperature is equal to or lower than the threshold temperature, the suction mechanism 24 may be driven during the movement of the cap 22. The threshold temperature is, for example, 25° C. As the temperature of the liquid decreases, the viscosity increases and bubbles are likely to be generated. In that respect, the controller 33 determines whether or not to drive the suction mechanism 24 depending on the temperature, and therefore the amount of liquid discharged from the cap 22 can be reduced compared to a case in which the suction mechanism 24 is driven regardless of the temperature.

The controller 33 may cause the liquid to be discharged from the nozzle 12 into the cap 22 before the suction of the inside of the cap 22 by the suction mechanism 24 is stopped. For example, the controller 33 may cause the liquid to be discharged from the nozzle 12 after the cap 22 has moved from the retreated position P1 to the facing position P2. The bubbles can be easily moved by supplying the liquid into the cap 22. The liquid ejecting head 13 may break the bubbles by applying the liquid discharged from the nozzles 12 to the bubbles.

For example, when the suction cleaning is performed, the liquid for moisturizing the cap 22 is not necessary. Therefore, the controller 33 may not cause the liquid to be discharged before the cap 22 reaches the closed space forming position P4.

The joint member 44 may be provided so as to be movable.

The suction flow path 23 may be formed by one tube without providing the joint member 44. The liquid ejecting apparatus 11 may include a positioning portion that determines the position of the tube. The positioning portion may be provided to be located vertically above the suction port 22*b* of the cap 22 where a part of the suction flow path 23 is located at the retreated position P1 and vertically below the suction port 22*b* of the cap 22 at the closed space forming position P4 to constitute the intermediate portion 45.

The controller 33 may cause the cap 22 to locate at the closed space forming position P4 while continuing the suction in the cap 22 by the suction mechanism 24. For example, when the cap 22 is moved from the retreated position P1 to the closed space forming position P4 for the suction cleaning, the cap 22 may be located at the closed space forming position P4 while the suction in the cap 22 is continued, and the liquid may be sucked from the nozzle 12. When the capping is performed, the controller 33 may stop the suction after the cap 22 is located at the closed space forming position P4 while suction in the cap 22 is continued and the moisturizing liquid is sucked from the nozzle 12.

The controller 33 may stop the suction in the cap 22 before the cap 22 moving from the retreated position P1 to the closed space forming position P4 is located at the intermediate position P3. That is, the controller 33 may stop the suction in the cap 22 in a state in which the suction port 22*b* of the cap 22 is located at the same position as the intermediate portion 45 or at a lower position than the intermediate portion 45.

The controller 33 may start the suction in the cap 22 after the movement of the cap 22 located at the retreated position P1 is started. The controller 33 may start the suction in the cap 22 at the same time as the movement of the cap 22 located at the retreated position P1 is started.

The liquid ejecting apparatus 11 may be configured not to include the atmosphere opening portion 31. The liquid ejecting apparatus 11 may open the inside of the cap 22 to the atmosphere by moving the cap 22 from the closed space forming position P4.

The controller 33 may drive the suction mechanism 24 continuously during the movement of the cap 22. For example, the controller 33 may start the driving of the suction mechanism 24 in a state in which the cap 22 is located at the retreated position P1, and may stop the driving of the suction mechanism 24 in a state in which the cap 22 is located at the closed space forming position P4.

The controller 33 may drive the suction mechanism 24 somewhere during the movement of the cap 22. For example, the controller 33 may start the driving of the suction mechanism 24 when the cap 22 moves to the facing position P2, and may stop the driving of the suction mechanism 24 when the cap 22 moves to the intermediate position P3.

The liquid ejecting head 13 may be a serial type in which the liquid is discharged while moving to perform the printing. The cap 22 may cap a serial type liquid ejecting head.

The liquid ejecting apparatus 11 may be a liquid ejecting apparatus that discharges or ejects a liquid other than ink. A state of the liquid discharged as a minute amount of liquid droplets from the liquid ejecting apparatus includes those having a granular shape, a tear shape, and a thread-shaped tail. The liquid referred here may be any material that can be discharged from the liquid ejecting apparatus. For example, the liquid may be one of a state in which a substance is in a liquid phase, or may be one including a liquid phase body such as a liquid with high or low viscosity, sol, gel water, other inorganic solvent, organic solvent, solution, liquid resin, liquid metal, or metal melt. The liquid includes not only a liquid as one state of a substance but also a liquid in which functional material particles formed of solid materials such as pigments and metal particles are dissolved, dispersed or mixed in a solvent. A typical example of the liquid includes ink, liquid crystal, or the like as described in the embodiment described above. Here, the ink includes general water-based ink, oil-based ink, or one formed by containing various liquid compositions such as gel ink or hot melt ink. As a specific example of the liquid ejecting apparatus, for example, there is an apparatus that discharges a liquid containing a material, in a dispersed or dissolved form, such as an electrode material or a color material used for manufacturing a liquid crystal display, an electroluminescence display, a surface light emitting display, a color filter, or the like. The liquid ejecting apparatus may be an apparatus that discharges a bio-organic matter used for biochip manufacture, an apparatus that is used as a precision pipette and discharges a liquid a sample, a textile printing apparatus, a micro dispenser, or the like. The liquid ejecting apparatus may be an apparatus that discharges lubricating oil with a pinpoint to a precision machine such as a watches or a camera, or an apparatus that discharges a transparent resin liquid of UV curable resin onto a substrate to form micro hemispherical lenses, optical lenses, or the like used in an optical communication device. The liquid ejecting apparatus may be an apparatus that discharges an etching solution of acid or alkali in order to etch a substrate or the like.

Hereinafter, the technical ideas and effects thereof grasped from the embodiment described above and the modification examples will be described.

A control method of a liquid ejecting apparatus including a liquid ejecting head that discharges a liquid from a nozzle, a cap configured to form a closed space where the nozzle is open, the cap being configured to move between a closed space forming position at which the cap forms the closed space and a retreated position at which the cap is farther from the liquid ejecting head than at the closed space forming position, and a suction mechanism configured to suck an inside of the cap, the method including: performing suction of the inside of the cap by the suction mechanism during movement of the cap from the retreated position to the closed space forming position.

According to this method, the inside of the cap is sucked by the suction mechanism during the movement of the cap from the retreated position to the closed space forming position. Therefore, even when bubbles are generated in the cap, the cap can be located at the closed space forming position after bubbles are sucked. Therefore, a concern that the bubbles in the cap come into contact with the nozzle can be reduced, and the deterioration of the quality of the liquid discharged from the nozzle can be suppressed.

In the control method of a liquid ejecting apparatus, the suction of the inside of the cap by the suction mechanism may be started before the cap starts the movement from the retreated position.

The bubbles in the cap may be generated according to the movement of the cap. In that respect, according to this method, since the suction mechanism sucks the inside of the cap before the cap starts the movement or simultaneously with the start of the movement, the generation of bubbles can be suppressed.

In the control method of a liquid ejecting apparatus, the cap may have a suction port that communicates with the suction mechanism via a suction flow path, the suction flow path may have an intermediate portion located above the suction port of the cap at the retreated position, and located below the suction port of the cap at the closed space forming position, and the suction of the inside of the cap by the suction mechanism may be stopped after the suction port of the cap reaches a position higher than the intermediate portion.

The bubbles in the cap are likely to be generated by the liquid or the like flowing from the suction flow path toward the suction port. Therefore, when the suction port is located at a position lower than the intermediate portion, the bubbles are likely to be generated, whereas when the suction port is located at a position higher than the intermediate portion, the bubbles are unlikely to be generated. According to this method, in a state in which the suction port is located at a position lower than the intermediate portion and the bubbles are likely to be generated, the suction by the suction mechanism is continued. Therefore, compared with a case in which the suction by the suction mechanism is stopped before the suction port reaches a position higher than the intermediate portion, a concern that the bubbles are generated can be reduced.

In the control method of a liquid ejecting apparatus, the suction of the inside in the cap by the suction mechanism may be stopped at a position at which the suction port of the cap is closer to the intermediate portion than to the liquid ejecting head in a vertical direction.

According to this method, the suction by the suction mechanism is stopped at a position at which the suction port is closer to the intermediate portion than to the liquid ejecting head after the suction port reaches a position higher than the intermediate portion. Therefore, a concern that the negative pressure by the suction mechanism affects the nozzle can be reduced.

In the control method of a liquid ejecting apparatus, the liquid may be discharged from the nozzle into the inside of the cap after the suction of the inside of the cap by the suction mechanism is stopped and before the cap reaches the closed space forming position.

The cap that moves from the retreated position to the closed space forming position discharges the liquid in the inside by suction by the suction mechanism. In that respect, according to this method, the liquid is discharged from the nozzle into the inside of the cap until the cap reaches the closed space forming position after the suction of the inside of the cap is stopped. Therefore, the cap located at the closed space forming position can keep the nozzle moisturize by the liquid in the inside.

A liquid ejecting apparatus including: a liquid ejecting head configured to discharge a liquid from a nozzle; a cap configured to form a closed space where the nozzle is open, the cap being configured to move between a closed space forming position at which the cap forms the closed space and a retreated position at which the cap is farther from the liquid ejecting head than at the closed space forming position; a suction mechanism configured to suck an inside of the cap; and a controller. The controller causes the suction mechanism to suck the inside of the cap during movement of the cap from the retreated position to the closed space forming position.

According to this configuration, the inside of the cap is sucked by the suction mechanism during the movement of the cap from the retreated position to the closed space forming position. Therefore, even when bubbles are generated in the cap, the cap can be located at the closed space forming position after bubbles are sucked. Therefore, a concern that the bubbles in the cap come into contact with the nozzle can be reduced, and the deterioration of the quality of the liquid discharged from the nozzle can be suppressed.

The liquid ejecting apparatus may further include an atmosphere opening portion configured to open the closed space to an atmosphere.

According to this configuration, the closed space formed by the cap located at the closed space forming position can be opened to the atmosphere by the atmosphere opening portion. Therefore, after the inside of the cap that forms the closed space is sucked and the liquid is discharged from the nozzle, the liquid in the cap can be discharged while the cap is located at the closed space forming position by opening the closed space to an atmosphere.

In the liquid ejecting apparatus, the controller may cause the suction mechanism to start suction of the inside of the cap before the cap starts the movement from the retreated position.

The bubbles in the cap may be generated according to the movement of the cap. In that regard, according to this configuration, since the suction mechanism sucks the inside of the cap before the cap starts the movement or simultaneously with the start of the movement, the generation of bubbles can be suppressed.

In the liquid ejecting apparatus, the cap may have a suction port that communicates with the suction mechanism via a suction flow path, the suction flow path may have an intermediate portion located above the suction port of the cap at the retreated position, and located below the suction port of the cap at the closed space forming position, and the controller may cause the suction mechanism to stop suction of the inside of the cap after the suction port of the cap reaches a position higher than the intermediate portion.

The bubbles in the cap are likely to be generated by the liquid or the like flowing from the suction flow path toward the suction port. Therefore, when the suction port is located at a position lower than the intermediate portion, the bubbles are likely to be generated, whereas when the suction port is located at a position higher than the intermediate portion, the bubbles are unlikely to be generated. According to this configuration, in a state in which the suction port is located at a position lower than the intermediate portion and the bubbles are likely to be generated, the suction by the suction mechanism is continued. Therefore, compared with a case in which the suction by the suction mechanism is stopped before the suction port reaches a position higher than the intermediate portion, a concern that the bubbles are generated can be reduced.

In the liquid ejecting apparatus, the controller may cause the suction mechanism to stop the suction of the inside of the cap at a position at which the suction port of the cap is closer to the intermediate portion than to the liquid ejecting head in a vertical direction.

According to this configuration, the suction by the suction mechanism is stopped at a position at which the suction port is closer to the intermediate portion than to the liquid ejecting head after the suction port reaches a position higher than the intermediate portion. Therefore, a concern that the negative pressure by the suction mechanism affects the nozzle can be reduced.

In the liquid ejecting apparatus, the intermediate portion may include a joint member that is fixed in a middle of the suction flow path.

According to this configuration, the intermediate portion provided in the suction flow path includes the joint member that is fixed to be provided. Therefore, the intermediate portion can be easily located at a position above the suction port of the cap located at the retreated position and at a position below the suction port of the cap located at the closed space forming position.

In the liquid ejecting apparatus, the controller may cause the liquid to be discharged from the nozzle into the inside of the cap after the suction of the inside of the cap by the suction mechanism is stopped and before the cap reaches the closed space forming position.

The cap that moves from the retreated position to the closed space forming position discharges the liquid in the inside by suction by the suction mechanism. In that respect, according to this configuration, the liquid ejecting apparatus discharges the liquid from the nozzle into the inside of the cap until the cap reaches the closed space forming position after the suction of the inside of the cap is stopped. Therefore, the cap located at the closed space forming position can keep the nozzle moisturize by the liquid in the inside.

What is claimed is:

1. A control method of a liquid ejecting apparatus including a liquid ejecting head that discharges a liquid from a nozzle, a cap configured to form a closed space where the nozzle is open, the cap being configured to move between a closed space forming position at which the cap forms the closed space and a retreated position at which the cap is farther from the liquid ejecting head than at the closed space forming position, and a suction mechanism configured to suck an inside of the cap, the method comprising:

performing suction of the inside of the cap by the suction mechanism during movement of the cap from the retreated position to the closed space forming position, the suction being performed prior to the cap reaching the closed space forming position.

2. The control method of a liquid ejecting apparatus according to claim 1, wherein the suction of the inside of the cap by the suction mechanism is started before the cap starts the movement from the retreated position.

3. The control method of a liquid ejecting apparatus according to claim 1, wherein the cap has a suction port that communicates with the suction mechanism via a suction flow path, the suction flow path has an intermediate portion located above the suction port of the cap at the retreated position, and located below the suction port of the cap at the closed space forming position, and the suction of the inside of the cap by the suction mechanism is stopped after the suction port of the cap reaches a position higher than the intermediate portion.

4. The control method of a liquid ejecting apparatus according to claim 3, wherein the suction of the inside in the cap by the suction mechanism is stopped at a position at which the suction port of the cap is closer to the intermediate portion than to the liquid ejecting head in a vertical direction.

5. The control method of a liquid ejecting apparatus according to claim 3, wherein the liquid is discharged from the nozzle into the inside of the cap after the suction of the inside of the cap by the suction mechanism is stopped and before the cap reaches the closed space forming position.

6. A liquid ejecting apparatus comprising:

a liquid ejecting head configured to discharge a liquid from a nozzle;

a cap configured to form a closed space where the nozzle is open, the cap being configured to move between a closed space forming position at which the cap forms the closed space and a retreated position at which the cap is farther from the liquid ejecting head than at the closed space forming position;

a suction mechanism configured to suck an inside of the cap; and a controller, wherein the controller causes the suction mechanism to suck the inside of the cap during movement of the cap from the retreated position to the closed space forming position, the suction being performed prior to the cap reaching the closed space forming position.

7. The liquid ejecting apparatus according to claim 6, further comprising:

an atmosphere opening portion configured to open the closed space to an atmosphere.

8. The liquid ejecting apparatus according to claim 6, wherein the controller causes the suction mechanism to start suction of the inside of the cap before the cap starts the movement from the retreated position.

9. The liquid ejecting apparatus according to claim 6, wherein the cap has a suction port that communicates with the suction mechanism via a suction flow path, the suction flow path has an intermediate portion located above the suction port of the cap at the retreated position, and located below the suction port of the cap at the closed space forming position, and the controller causes the suction mechanism to stop suction of the inside of the cap after the suction port of the cap reaches a position higher than the intermediate portion.

10. The liquid ejecting apparatus according to claim 9, wherein the controller causes the suction mechanism to stop the suction of the inside of the cap at a position at which the suction port of the cap is closer to the intermediate portion than to the liquid ejecting head in a vertical direction.

11. The liquid ejecting apparatus according to claim 9, wherein the intermediate portion includes a joint member that is fixed in a middle of the suction flow path.

12. The liquid ejecting apparatus according to claim 9, wherein the controller causes the liquid to be discharged from the nozzle into the inside of the cap after the suction of the inside of the cap by the suction mechanism is stopped and before the cap reaches the closed space forming position.

13. A control method of a liquid ejecting apparatus including a liquid ejecting head that discharges a liquid from a nozzle, a cap configured to form a closed space where the nozzle is open, the cap being configured to move between a closed space forming position at which the cap forms the closed space and a retreated position at which the cap is farther from the liquid ejecting head than at the closed space forming position, and a suction mechanism configured to suck an inside of the cap, the method comprising:

performing suction of the inside of the cap by the suction mechanism during movement of the cap from the retreated position to the closed space forming position, wherein the liquid is discharged from the nozzle into the inside of the cap after the suction of the inside of the cap by the suction mechanism is stopped and before the cap reaches the closed space forming position.

* * * * *